US005168989A

United States Patent [19]

Benno

[11] Patent Number: 5,168,989

[45] Date of Patent: Dec. 8, 1992

[54] PACKAGE MEMBER, METHOD FOR MAKING PACKAGES, AND PACKAGES OF MULTIPLE CONTAINER UNITS

[76] Inventor: Edward L. Benno, 17960 W. Hwy 120, Grayslake, Ill. 60030

[21] Appl. No.: 688,975

[22] Filed: Apr. 22, 1991

[51] Int. Cl.[5] ..... B65D 71/06

[52] U.S. Cl. ..... 206/143; 53/398; 53/399; 206/162

[58] Field of Search ..... 53/48.5, 134.1, 398, 53/399, 413, 585, 591; 206/139, 142, 143, 162, 165, 198, 200, 427, 432, 497, 430; 229/DIG. 12

[56] References Cited

U.S. PATENT DOCUMENTS

| | | | |
|---|---|---|---|
| 1,981,647 | 11/1934 | Johnson . | |
| 2,313,731 | 3/1943 | Brogden . | |
| 2,769,535 | 11/1956 | Bruce | 206/432 |
| 2,864,212 | 12/1958 | Bruce | 53/413 |
| 3,023,554 | 3/1962 | Hlavacek . | |
| 3,286,833 | 11/1966 | Chadbourne | 206/192 |
| 3,387,702 | 6/1968 | Reynolds et al. | 206/162 |
| 3,416,653 | 12/1968 | Farquhar | 53/398 |
| 3,454,156 | 7/1969 | Chatten | 206/430 |
| 3,656,614 | 4/1972 | Jacobsen | 229/DIG. 12 |
| 3,746,160 | 7/1973 | Thompson et al. | 229/DIG. 12 |
| 3,756,397 | 9/1973 | Ganz | 229/DIG. 12 |
| 3,817,373 | 6/1974 | Samsing | 206/432 |
| 4,094,406 | 6/1978 | Zietzschmann | 206/432 |
| 4,454,705 | 6/1984 | Benno | 53/398 |
| 4,754,879 | 7/1988 | Benno | 206/432 |
| 4,880,115 | 11/1989 | Chaussadas | 206/427 |
| 4,930,633 | 6/1990 | Gloyer | 206/428 |
| 4,932,528 | 6/1990 | Benno | 206/432 |
| 4,981,255 | 1/1991 | Schultz | 229/117.23 |

FOREIGN PATENT DOCUMENTS

| | | | |
|---|---|---|---|
| 1503707 | 10/1967 | France | 206/432 |
| 0938753 | 10/1963 | United Kingdom | 206/162 |

*Primary Examiner*—Jimmy G. Foster

[57] ABSTRACT

A package member of a paperboard-like material with handle means at the upper end and with a bifurcated lower end of two flaps. The invention further involves a method for using the package member to make packages with a plurality of container units. The container units can be a single container or a stack of containers. The invention further includes packages of the package member, the plurality of container units, and a broad substantially-tensioned elastic plastics material band encircling and holding the container units with the packaging member together to enable a person to safely carry and jostle the package by holding the handle means with the package depending therefrom.

18 Claims, 3 Drawing Sheets

Fig. 1
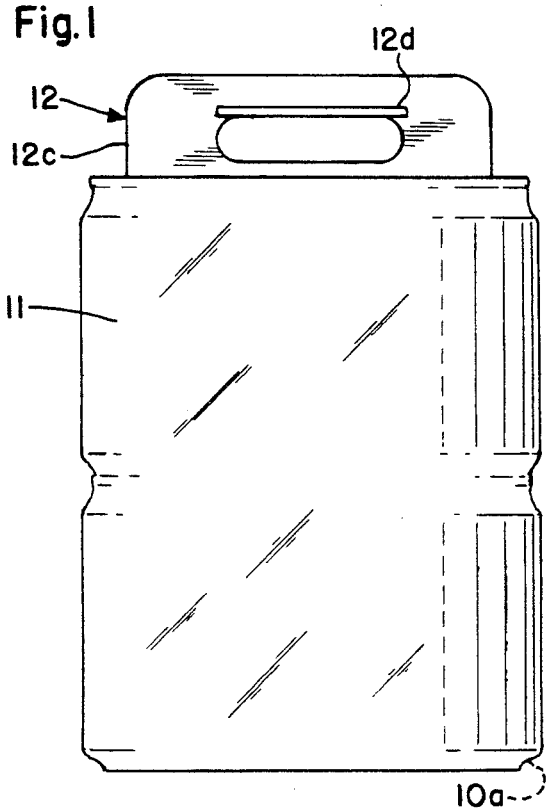
Fig. 2
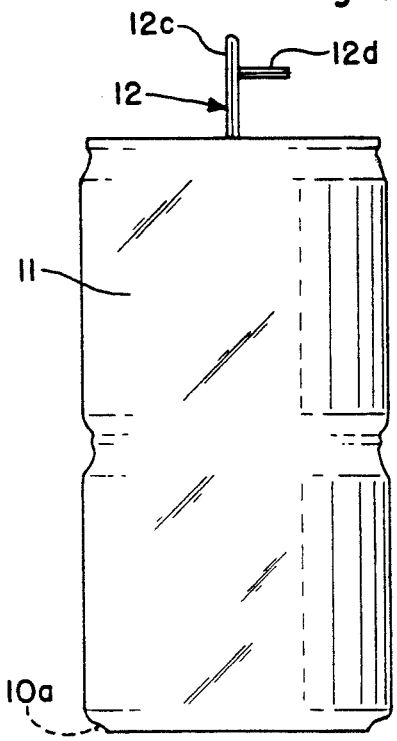
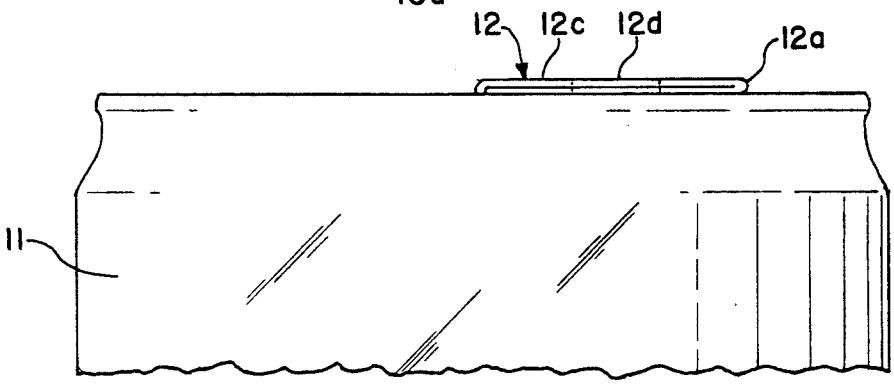
Fig. 3
Fig. 4
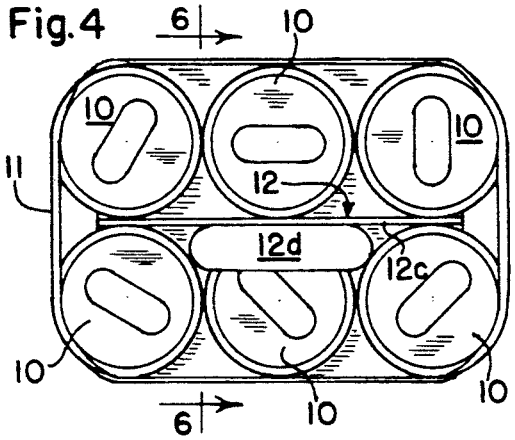
Fig. 5
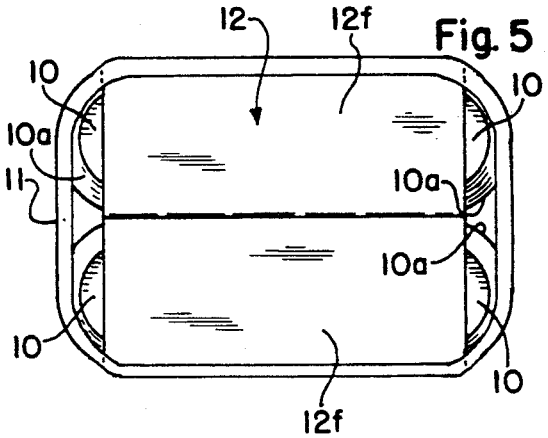

PACKAGE MEMBER, METHOD FOR MAKING PACKAGES, AND PACKAGES OF MULTIPLE CONTAINER UNITS

BACKGROUND OF THE INVENTION

The invention relates to the art of secondary packaging, primarily of food and beverages for consumers, and primarily for the making, distributing, and selling of a substantial number of primary containers in a single complete secondary package to a consumer. Probably the most common number of such primary containers in a secondary package, particularly for beverages, is six. In addition to six packs, consumers are generally aware of other secondary packages such as four packs, eight packs, twelve packs and even twenty four packs. Twenty four packs are often called case packs or cases.

The primary containers can be rectilinear cartons, bottles of myriad shapes, or generally cylindrical cans. The twelve ounce two-piece aluminum necked-in can is probably the most widely used primary container, particularly for beverages.

While secondary packaging costs are very important to producers and distributors, there are a number of other factors which are particularly important to consumers and which can affect their decision to purchase a certain product. Without attempting to be complete or to list those factors in any order of importance, they are such as ease of handling, ease of carrying, ease of storing, ease of primary container removal from the secondary package, safety factors involved in consumer use of the secondary package, and waste, recycling and other environmental factors.

Further as background, secondary packaging as referred to above is a crowded and extensive art, which is represented at any one period of time in the market place by a relatively small number of different kinds of secondary packages.

SUMMARY OF THE INVENTION

In addition to a number of primary containers, the invention involves two unique packaging elements.

The first element is a broad thin tube of stretchable, elastic plastics material capable of exerting and maintaining substantial compressive forces on an object when properly stretched and applied about the object. The description, formation, and application of that element in different forms are the subject matter of a number of patents issued to the inventor here. Reference is made to two of those patents to keep the description here concise and yet enable one to more fully understand the subject invention. The first is U.S. Pat. No.4,454,705 which describes stretchable plastics materials and teaches how in the form of tubes they can be highly stretched and applied about objects. The second is U.S. Pat. No.4,730,437 which teaches methods and machines for processing such tubes continuously from a roll of tubing, and applying individual tubes to objects.

The second packaging element is a member formed of a paperboard-like flexible material. That element includes handle means at the upper end thereof, a central sheet section and a bifurcated lower section of two flaps.

The only embodiment of the package of the invention shown in the drawings is a secondary package of twelve beverage cans such as the well known twelve-ounce two-piece necked-in aluminum beverage can. From a study of the drawings and the description, those skilled in this art will understand that other embodiments of the invention may comprise certain cartons or bottles, or a single layer of primary containers, or different numbers of container units.

The second packaging element of the invention has a number of important functions for the practice of the invention. Those functions are to provide a convenient carrying arrangement for a relatively heavy package, and to provide that the carrying arrangement be positive, simple for a person such as a child to perceive, and safe. A further function is that second element must maintain or substantially maintain the rectangular array of the container units in the package, and that in cooperation with the first element it substantially hold relatively heavy container units from falling from the package when a person carries the package in a depending condition from the handle means of the second element and jostles the package as a person normally does at a store and in transporting and storing the package for eventual use. The main function of the first element is to closely cooperate and interact with the container units and the second element to tightly hold the container units together with and on the second element to enable the second element to have the functions ascribed above to it. One feature of the complete package of the invention in an embodiment of three or more container units in each row of the two rows in the array is that the individual containers are relatively easy to remove from the package without the need for tear strips or the like. The top center containers are removed first, and the stretched tube will then lose its tension to permit lifting of the end containers from the tube.

Other objects and features of the invention will be apparent upon a perusal of the hereinafter following detailed description read in conjunction with the drawings.

DESCRIPTION OF THE DRAWINGS

FIG. 1 is a front elevational view of one preferred embodiment of the package of the invention;

FIG. 2 is an end elevational view of the package of FIG. 1;

FIG. 3 is an enlarged end elevational view of the upper portion of the package of FIG. 2 showing the handle in a flat position for stacking of the packages;

FIG. 4 is a top plan view of the package of FIG. 1;

FIG. 5 is a bottom plan view of the package of FIG. 1;

DETAILED DESCRIPTION OF THE INVENTION

Figure 6:
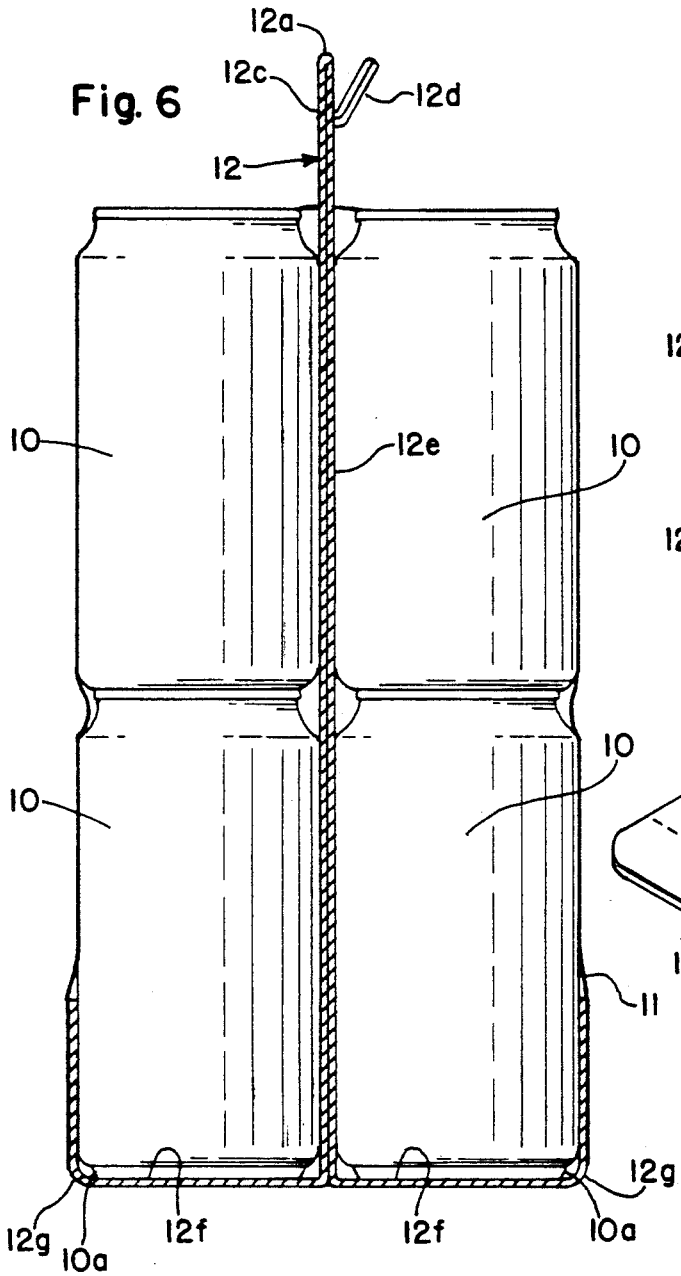
FIG. 6 is an enlarged sectional view of the package of FIGS. 1–5 taken along the line 6—6 of FIG. 4.

In the one preferred embodiment of the package of the invention shown in the drawings, there are six container units. Each container unit comprises a vertical stack of two cans for a total of 12 cans. The cans 10 may be directly viewed in the top plan view of FIG. 4 and the sectional view of FIG. 6. The cans 10 are not directly shown in FIGS. 1–3 and 8 because in those views they are covered by the first element of the package of the invention, the highly-tensioned elastic plastics-material tube 11. The cans 10 in the drawings are intended to depict the well known twelve ounce necked-in two-piece aluminum beverage can. Such cans are punched and drawn from a piece of aluminum into a very thin-walled open-top receptacle to be filled with a beverage. After filling the second piece of the can, the lid usually with a non-detachable pull-tab opener, is rolled on the top of the receptacle to seal the can. The can is called necked-in because the upper end is drawn close to the shape of a frustum. The base of such cans are commonly formed with a depending annular ring which is shown at 10*a* in FIGS. 1, 2, 5 and 6. The bottom of the can within the annular ring is generally concave because such cans are often pressurized with carbon dioxide. In one common commercial form, the annular ring 10*a* has an outer diameter less or substantially equal to the inner diameter of the upwardly projecting rim on the can lid. Thus a stack of two cans will partially nest. That feature can be noted in FIG. 6 where it may be seen that the annular ring 10*a* of the lower two cans 10 is absent from the showing of the upper two cans 10.

Figure 7:
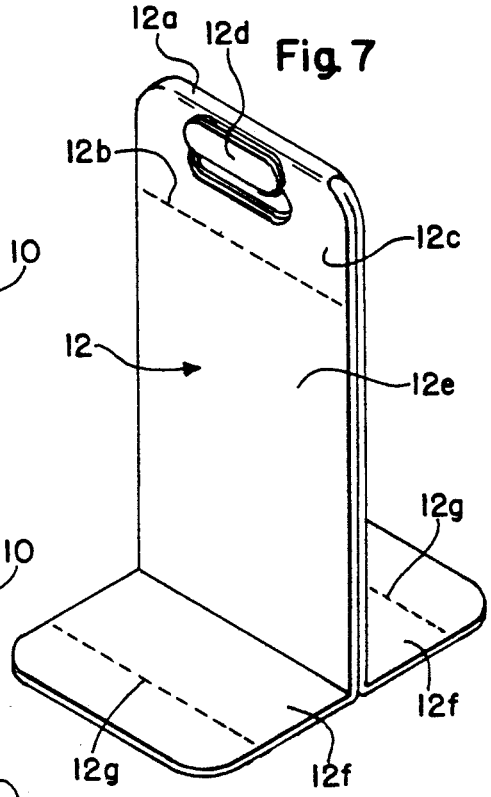
FIG. 7 is a perspective view of the second packaging element of the invention.

To further describe the package of the invention, the second packaging element is shown in one preferred embodiment at 12 in FIG. 7. As shown in FIG. 7, the element 12 is made from a paperboard-like flexible material generally as an elongated sheet. The sheet is folded transversely at the longitudinal center thereof to provide a fold line 12*a*. Both layers of the folded sheet may be prefolded at 12*b* so that the section between fold lines 12*a* and 12*b*, which is indicated at 12*c*, may be folded down as shown in FIG. 3 when the package is completed to permit vertical stacking of such packages for shipment and storage. The section 12*c* may be called the handle section 12*c* of the element 12.

Figure 8:
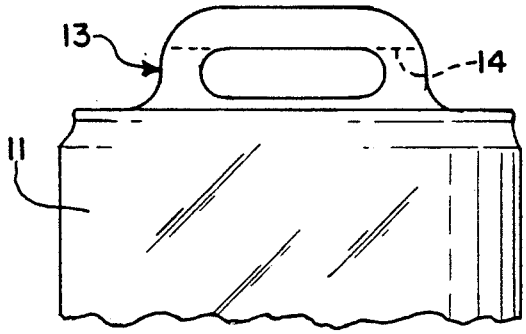
FIG. 8 is a front elevational view of the upper portion of a package such as the package of FIGS. 1–6, but showing another embodiment of the handle means.
Figure 9:
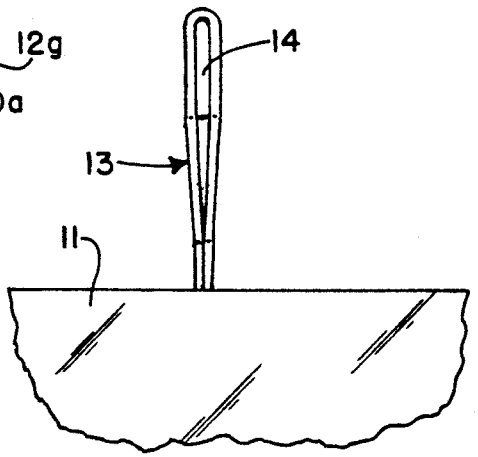
FIG. 9 is an enlarged end elevational view of a portion of the package portion shown in FIG. 8.

In a preferred embodiment, the handle section 12*c* is provided with an elongated opening, rounded at both ends, which is formed by cutting section 12*c* along a C-shaped line to produce the flap 12*d* shown in the drawings. With the flap 12*d* acting as a cushion, a person may insert three or four fingers through the opening provided and carry the element 12 in a depending condition. FIGS. 8 and 9 show other embodiments of the handle section 12*c*. In FIG. 8 it may be seen that the handle section 13 is formed, as by cutting the folded sheet of the element 12, to provide a handle section above the fold line 12*b* that is substantially narrower than the width of the remaining sections of the sheet. Also, the opening in section 13 is circumferentially continuous and does not have a cushion flap. Handle section 13 shows a further modification in the provision of a reinforcing strip 14. Strip 14 is secured, as with an adhesive, between the two layers of section 13 and above the hand grip opening.

FIG. 7 shows the two layers of the folded sheet of element 12 below the fold line 12*b* as central section 12*e*. The central section 12*e* has a height substantially equal to the height of the container unit. In the embodiment shown in the drawings that height is substantially the height of the stack of two cans 10. It may be seen that if the container unit is a single can, the height of the central section 12*e* would be substantially the height of one can 10. Further, if the container units are bottles with greatly reduced diameter upper neck portions so that a substantially open space would exist between a two-row-array of those bottles, the central section 12*e* may be made shorter than the height of the bottles. The width of the section 12*e* should be such as to engage some portion of the side wall of each container in each container unit. That some portion should at the very least be the side wall portion of the container having the greatest diameter. In the embodiment of the drawings, and except for an almost imperceptible bulge produced about the middle of a thin-walled aluminum can by pressurized contents, most of the side wall of the cans from the rim to the base will engage the central section 12*e*. Again in reference to the embodiment shown in the drawings, with substantially cylindrical containers the width of section 12*e* should be greater than the sum of the diameters, measured at the greatest diameters of all of the container units in one of the rows of the array minus one of those diameters. For example, with three container units in a row and with a maximum side wall diameter of about 2 and ½ inches, the width of section 12*e* should be more than 5 inches. That arrangement is shown in the top plan view in FIG. 4. It may be here noted that while the central section 12*e* aligns the two rows of container units in a rectangular array, section 12*e* will not by itself maintain the rectangular array shown in FIG. 4. Those skilled in this art will readily see that without more, the containers can easily roll in opposite directions toward a diamond configuration. More likely, with the substantial tension of the first element or tube 11, the center container units will slide outwardly as the tube 11 tries to assume a circular configuration.

FIG. 7 further shows that at the lower end of the central section 12*e*, the two layers of the element 12 are each folded perpendicular to section 12*e* to form a lower section of flaps 12*f*. In making the package of the invention, the outer marginal edge portions of the flaps 12*f* are folded upwardly along fold lines 12*g*. That folding of the flap 12*f* can be seen in the cross section of FIG. 6. The portions of the flaps 12*f* between the fold lines 12*g* and the central section 12*e* have a length, measured from section 12*e* to fold line 12*g*, of substantially that of the base area of the cans 10 above the rings 10*a*. Those portions which may be called the base portions, should be a width sufficient to span substantial areas of the bottoms of the end cans 10 in the array, as can be seen in FIG. 5. Conveniently that width can be the width of central section 12*e*, but it could be slightly shorter or even longer.

The outer marginal edge portions of the flaps 12*f* beyond the fold lines 12*g* may be called the side portions of the flaps 12*f*. The side portions of the flaps 12*f* are important to the practice of the invention. Although the side portions of the flaps 12*f* are shown in the drawings as having a width substantially that of the base portion of the flaps 12*f* and a length or height a little less than one half of the height of one of the cans 10, those side portions can have other widths and lengths. The width of the side portions of the flaps 12*f* should be great enough to prevent the container units between the end container units of the rows from sliding outwardly away from the central section 12*e* under the compressive force of the tensioned tube 11. Thus in a three container unit row, and with the side portion at the center of the array, a width of the side portions of the flaps 12*f* of about one container diameter would be sufficient. It is also important that the width and length of the side portions of the flaps 12*f* be such that when the tensioned tube 11 is in frictional engagement with the outer surface of the side portions of the flaps 12*f*, the weight of the container units on the base portions of the flaps 12*f* will not cause the flaps 12*f* to move or pivot downwardly from the junctions to the central section 12*e* when the package is carried in a depending condition from the handle section 12*c* and is jostled as might normally be expected of a person carrying such a package. The most economical size for the side portions of the flaps is difficult to describe with more specificity than the foregoing description. That difficulty occurs because many other factors may control the size of the side portions of the flaps 12*f*. Those other factors are the coefficients of friction of the internal surface of the tube 11 and the outer surface of the side portions of the flaps 12*f*, the normal force of the tensioned tube 11 on those side portions, the weight of the container units exerted on the base portions of the flaps 12*f*, and the stiffness of the paperboard-like material of the element 12.

Figure 10:
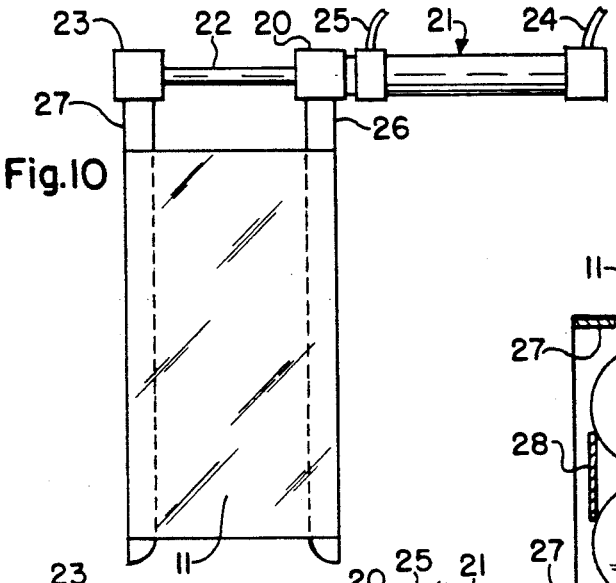
FIG. 10 is a side elevational view of an apparatus that can be used in practicing a preferred embodiment of the method of the invention.
Figure 11:
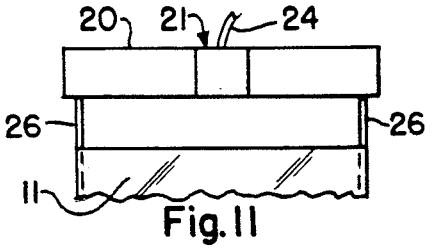
FIG. 11 is an end elevational view of the upper portion of the apparatus of FIG. 10.
Figure 12:
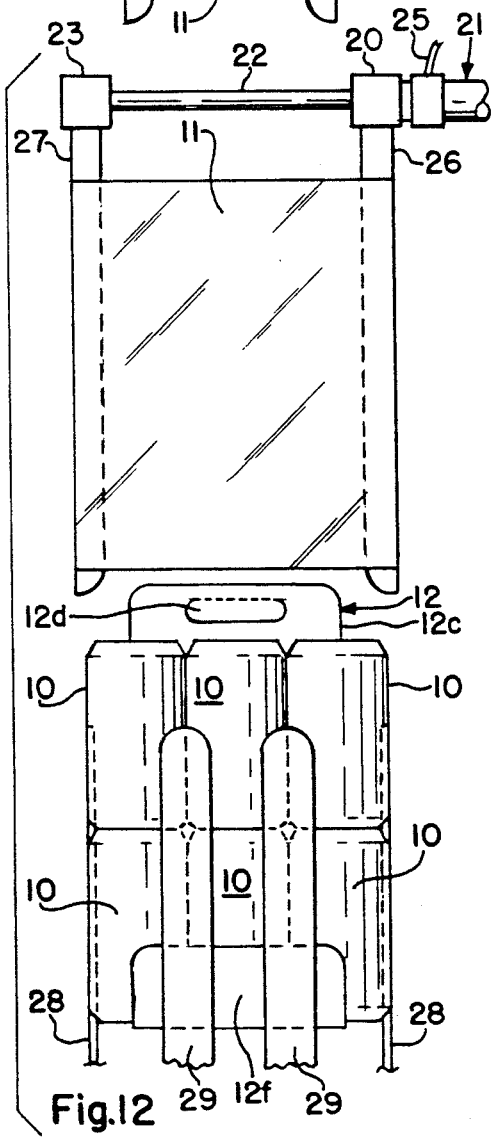
FIG. 12 is a side elevational view of the apparatus of FIG. 10 but showing the plastic tube or first element of the package of the invention, as stretched, with one embodiment of the holding means for holding container units and the second package element for the method of the invention.

For the further description of the construction of the package of the invention, reference is made to FIGS. 10–15 where one embodiment of some simple apparatus is shown for the practice of the method of the invention. While the apparatus is shown suspended in space, those skilled in this art will understand how the apparatus may be held and handled. Vertical up and down alignment of the apparatus with the long side of the drawing is intended in FIGS. 10–13. FIGS. 10–12 show an elongated bar 20 fixed to the cylinder portion of an air cylinder or motor 21. The piston rod 22 of the air cylinder 21 is journaled through bar 20 and secured at the longitudinal center of another bar 23. When air under pressure is directed into the head end of cylinder 21 through conduit 24, bar 23 is moved away from bar 20, and when the air is directed into the rod end of cylinder 21 through conduit 25, bar 23 is moved toward bar 20.

Secured to and depending from bar 20 are a pair of spaced apart stretching jaws 26. Jaws 26 are rigid thin elongated members, and are spaced apart a distance slightly greater than width of the array of container units comprising cans 10 as may be seen in FIGS. 14 and 15. The actual spacing of the various parts shown in FIGS. 10–15 of the drawings should be understood to be only representational of this written description. Tighter, closer spacing should be sought in the actual apparatus.

Figure 14:
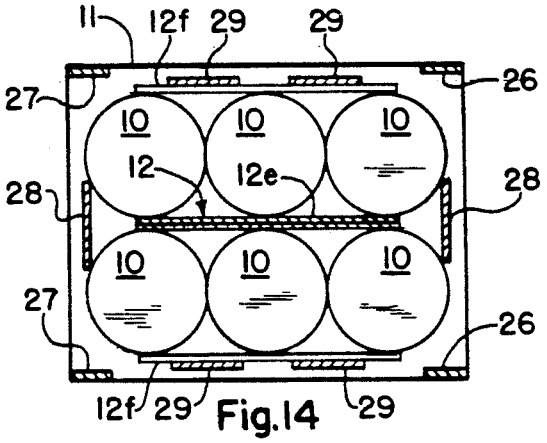
FIG. 14 is a cross sectional view, slightly enlarged, taken along the line 14—14 of FIG. 13.

Secured to and depending from bar 23 are another pair of stretching jaws indicated at 27. The spacing of jaws 27 is the same as that of jaws 26. When the jaws 26 and 27 are positioned in the closed position of FIG. 10, the tube 11 in an unstretched condition may be placed about the jaws 26 and 27. When the jaws 26 and 27 are moved apart by the cylinder 21, the tube 11 will be stretched to its highly stretched position shown in FIG. 12. In the stretched position of the tube 11, the spacing between jaws 26 and 27 is sufficient to permit telescopic reception of the array of container units comprising cans 10 therewithin as shown in FIG. 14.

For brevity of this description, reference is made to U.S. Pat. No. 4,454,705 for further details of what constructions of tube 11 are desirable for the purposes of this invention. It is believed sufficient here to say that the tube 11 should have a length sufficient to encircle more than one half of the lower portion of the array of container units. In various reductions to practice of the invention with the twelve can array of the present embodiment it was found desireable, perhaps for some esthetic reasons, to make the tube 11 longer than the height of the array of twelve cans. With that selected length, the tube 11 smoothly lapped the marginal edges of the upper and lower surfaces of the array as shown in FIGS. 4 and 5. The lap of the lower surfaces as shown in FIG. 5 may have some effect toward helping to support the container units, particularly if the thickness of the tube material is substantial, such as three mils. The tube 11 in size and material should further be selected to produce a compressive force about the array and against the side portions of the flaps 12*f* to firmly hold the package together and permit it to be carried and handled as described previously.

Further in the method of the invention, the lower portion of FIG. 12 shows one embodiment for holding the container units and the element 12. Six holding arms are provided and shown in FIGS. 12–15 as two end holding arms 28, and two pairs of side holding arms 29. With the arms fixed or moved to the positions shown in FIGS. 12 and 14, the element 12 is placed and folded into cooperation with the two rows of container units comprising can 10 as shown. That cooperation is that central section 12*e* is positioned with each row of container units against one side thereof and in contact therewith. The upper handle section 12*c* extends above the container units. The base portions of the flaps 12*f* are positioned against the bottoms of the container units as can be seen in FIG. 6, and the side portions of the flaps 12*f* are positioned against the lower outer side walls of the container units as can be seen in FIGS. 6 and 12.

The holding arms 28 and 29 are relatively thin and rigid, and have lengths sufficient to engage the side walls of both the upper cans 10 and the lower cans 10 of the six container units. The extent of engagement of the holding arms 28 and 29 with the upper cans 10 need only be that which will hold the upper cans 10 from falling off the lower cans 10 as the container units, the element 12, and the holding arms 28 and 29 are telescopically received within the stretched tube 11. That telescopic reception can be seen from a study of FIGS. 12, 13, and 14. If the container units are a single layer of cans 10, the holding arms 28 and 29 may extend upwardly merely to the top of the side portions of the flaps 12*f*.

The holding arms 28 have a width so that when they engage the cans 10 as shown in FIG. 14, the outer surface of the arms 28 lies within the plane of tangency across the ends of the array of container units. That arrangement allows the ends of the stretched tube 11 between stretching jaws 26 and between stretching jaws 27 to be positioned closer to the ends of the array than the example showing of FIG. 14.

The holding arms 29 should have a width such that the container units between the end units can not slide outwardly away from the central section 12*e* of the element 12. Thus it may be seen that each pair of arms 29 on each longitudinal side of the array could be formed as a single wide plate. The longitudinal edge of each arm 29 on the sides thereof toward the ends of the array should extend far enough toward the ends of the array to trap the container units between arms 28 and 29. The longitudinal sides of the arms 29 toward the ends of the array need not be a continuous straight edge to perform the trapping function described. It should be noted that the arms 29 also hold the side portions of the flaps 12*f* against the lower outer side walls of the container units as may be seen in FIGS. 12–15.

Figure 13:
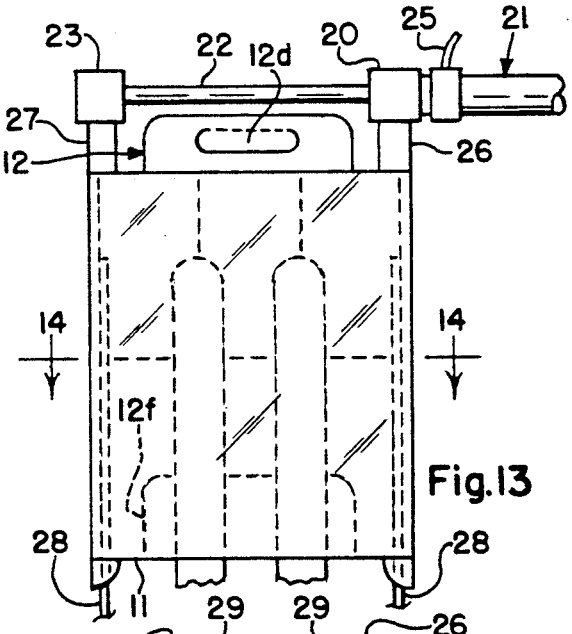
FIG. 13 is a view similar to FIG. 12 but showing telescopic reception between the separate parts shown in FIG. 12.
Figure 15:
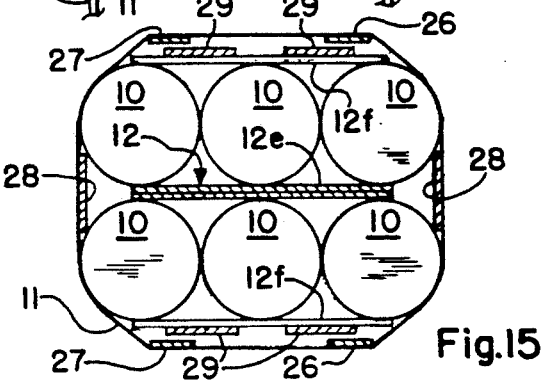
FIG. 15 is a view similar to FIG. 14 but showing the apparatus of FIG. 10 moved from the showing of FIG. 14 to the showing of FIG. 10.

FIG. 12 does not show a horizontal support surface beneath the container array and element 12. It will be obvious to those skilled in this art that a platform, table or conveyor within the horizontal area outlined by the holding arms 28 and 29 can support the array and element prior and during the package making steps of the method. The final package making steps are that after the assembly shown below the stretched tube 11 in FIG. 12 has been telescopically received within the stretched tube 11 as shown in FIGS. 13 and 14. The air cylinder 21 is operated to move the stretching jaws 26 and 27 to the closed position shown in FIGS. 10 and 15. FIG. 15 shows that in accordance with the teachings of U.S. Pat. No. 4,454,705 the high compressive force of the stretched tube 11 is substantially transferred to the end container units of the array to tightly grip the array, and the stretching jaws 26 and 27 can be slid along their longitudinal axes to remove them from the package.

The removal of holding arms 28 and 29 need not follow the removal of the closed stretching jaws 26 and 27. It is contemplated that within the scope of the invention, the holding arms 28 and 29 can be removed at any convenient time after telescopic reception of the container array within the stretched tube 11.

With the removal holding arms 28 and 29 and the stretching jaws 26 and 27, the completed package will appear substantially as shown in FIGS. 1–5 and as previously described. In reductions to practice of the twelve beverage can embodiment of the invention it appeared that to some extent the can nesting described relative to FIG. 6 favorably affected the integrity of the completed package.

Having described the invention, it is to be understood that changes can be made in the described embodiments by a person skilled in the art within the spirit and scope of the claims.

I claim:

1. A unitary package member for at least four container units encircled by a broad substantially-tensioned elastic plastics material tube that in an initial untensioned condition is substantially smaller in circumferential dimension than the largest horizontal circumferential dimension about said container units and that is applied by a stretching of said tube circumferentially outwardly producing substantial tension forces in said tube and applying said tube circumferentially about said container units with said tube exerting substantial compressive forces against said container units and wherein the weight of each of said container units is substantially the weight of water filled containers of comparable volume, said member formed of a sheet of a paperboard-like flexible material, said sheet having a central section of a height substantially the height of one of said container units and a width sufficient to engage the side walls of one half of said container units positioned in a contiguous row against one side of said central section, said sheet having an upper section integral with the upper marginal edge of said central section, said upper section including handle means for carrying said member in a depending condition, said sheet having a lower section integral with the lower marginal edge of said central section, said lower section comprising a pair of flaps, each of said flaps comprising a base portion having one edge thereof contiguous to said central section and foldable to extend in a plane perpendicular to and including said lower marginal edge of said central section, each of said base portions having a width at least as wide as said width of said central section and a length substantially equal to the distance one of said container units extends outwardly from said central section when positioned against one side of said central section, each of said flaps further comprising a side portion having one edge contiguous to the edge of said base portion parallel to said one edge thereof and foldable to extend upwardly against the side walls of said container units when positioned against one side of said central section, each of said side portions having a height sufficiently great when extending upwardly against the side walls of said container units holding said flaps against a folding movement downward from said central section under the weight of said container units when each one half of said container units is positioned in a contiguous row against the opposite sides of said central section and on said base portions with said side portions folded upwardly against the outer sides of said container units and with said stretched and tensioned tube compressively encircling said container units and the outward sides of said side portions and when said handle means is grasped to carry said member in a depending condition.

2. A unitary package member as defined in claim 1, said member being formed from a single elongated sheet of a paperboard-like flexible material, said sheet being folded transversely at the longitudinal center thereof to form said member with said upper section and said central section comprising two side-by-side layers and said lower section comprising said pair of flaps with each of said flaps being folded from the extending ends of said single elongated sheet.

3. A unitary package member as defined in claim 2, said handle means comprising said upper section formed to have aligned openings through both of said side-by-side layers, said openings being spaced downwardly a certain distance from the longitudinal central fold line of said single elongated sheet and being of a size to permit the fingers of a person to enter through said openings to grasp said upper section as a handle for carrying said member.

4. A unitary package member as defined in claim 3, and a reinforcing strip secured between said side-by-side layers of said upper section and between said openings and said longitudinal central fold line of said single elongated sheet.

5. The method of making a package with an even number of generally cylindrical container units comprising the steps of:

providing an elongated flat planar member of a length substantially the height of one of said container units and of a paperboard-like flexible material and formed to have handle means extending from one end of said member and a pair of flaps extending in opposite directions from the other end of said member distances greater than the diameter of the bottom wall of one of said container units, positioning and holding one half of said container units against one side of said member and the other half of said container units against the other side of said member with said container units positioned to extend in a parallel side-by-side relationship with the bottom walls of said container units in a plane perpendicular to the plane of and including said other end of said member, positioning one of said flaps against the bottom walls of said one half of said container units and the other of said flaps against the bottom walls of said other half of said container units, positioning and holding the ends of said flaps which extend distances greater than the diameter of the bottom wall of said container units against the lower sides of said container units, providing an elastic plastics material tube of an unstretched circumferential dimension substantially smaller than the circumferential dimension about said ends of said flaps measured substantially in said plane of said bottom walls of said container units and further providing said tube of a length substantially greater than one half of the height of said container units, providing four stretching arms each of a length at least as long as the length of said tube and inserting said arms in a parallel spaced-apart relationship into said tube, moving said arms apart to stretch said tube to an extent and in a pattern enabling close telescopic reception of said container units as held with said member and said flaps within said tube, and between said arms, while continuing to hold said container units with said member and said flaps as described, telescopically applying said tube and said arms about said container units with said member and said flaps with the longitudinal axes of said container units parallel to the longitudinal axes of said arms and with one end portion of said tube extending substantially over the surface of said ends of said flaps, and thereafter moving said arms along the longitudinal axes thereof until said arms are separated from any contact with said tube and said container units.

6. In a method as defined in claim 5, in the step of while continuing to hold said container units with said member and said flaps as described, to further telescopically apply the marginal edge of said one end portion of said tube over the surface of said ends of said flaps and a certain distance beyond said flaps.

7. In a method as defined in claim 5, in the step of providing an elastic plastics material tube, to provide said tube of a length greater than the height of said container units.

8. In a method as defined in claim 7, wherein each of said generally cylindrical container units comprises a vertical stack of two cans, and in the step positioning and holding the ends of said flaps against the lower sides of said container units to further hold the upper cans of said container units in said vertical stack.

9. In a method as defined in claim 5, after the step of while continuing to hold said container units with said member and said flaps as described, the additional step of discontinuing to hold said container units with said member and said flaps as described.

10. A package of an even number of container units wherein the weight of each of said container units is substantially the weight of water filled containers of comparable volume, said package comprising a sheet of paperboard-like flexible material, one half of said even number of container units being disposed against each side of said sheet in two contiguous rows and in a rectangular array, handle means integral with and at the upper end of said sheet and said container units for carrying said sheet in a depending condition from said handle means, said sheet further comprising a pair of flaps with one edge of each thereof integral with the lower marginal edge of said sheet at the bottom of said container units, each of said flaps extending beneath and against the bottoms of said container units one one side of said sheet, an edge portion of each of said flaps opposite from said one edge being folded upwardly and against said container units, a substantially tensioned elastic plastics-material band that in an initial untensioned condition is substantially smaller in circumferential dimension than the largest horizontal circumferential dimension about said container units and that is substantially tensioned by a stretching of said band circumferentially outwardly producing substantial tension forces in said band, said stretched and applied circumferentially about and engaging the outer surface of said edge portion of each of said flaps and said container units to an upward extent of more than one half of the height of said container units, and said outer surface of said edge portion of each of said flaps having a height and area in sufficiently great planar contact with the inner surface of said substantially tensioned band holding said edge portion of each of said flaps from being moved downwardly by the weight of said container units and said flaps when a person carries and normally jostles said package by grasping said handle means with said package in a depending condition therefrom.

11. A package as defined in claim 10, and the lower end of said band covering the marginal areas of said flaps which are contiguous to said edge portions and beneath and against the bottoms of said container units.

12. A package as defined in claim 10, wherein said container units are generally cylindrical container units, and the portions of said sheet between the sidewalls of said container units have a width wider than the sum total of the diameter dimensions of the number of container units in one of said rows measured at the largest diameter of one of said container units minus the diameter dimension of one of said container units measured at the largest diameter of one of said container units.

13. A package as defined in claim 12, wherein the portions of said flaps extending beneath and against the bottoms of said container units have a width measured in the direction of said rows substantially equal to said width of said sheet between the sidewalls of said container units.

14. A package as defined in claim 13, wherein said edge portion of each of said flaps has a width measured in the direction of said rows substantially equal to said width of said portions of said flaps extending beneath and against the bottom of said container units.

15. A package as defined in claim 14, wherein said band encircles and engages the outer surface of said edge portion of each of said flaps and said container units to an upward extent at least to the upper end of said container units.

16. A package as defined in claim 15, wherein each of said generally cylindrical container units comprises a single cylindrical can.

17. A package as defined in claim 15, wherein each of said generally cylindrical container units comprises a vertical stack of two cylindrical cans.

18. A package as defined in claim 17, wherein the upper and lower ends of said cans are shaped to provide nesting between the lower end of the upper can and the upper end of the lower can in said vertical stack of two cylindrical cans.

* * * * *